United States Patent [19]

Miller

[11] 4,025,017

[45] May 24, 1977

[54] WALL MOUNTED LIFT FOR A TELEVISION RECEIVER OR THE LIKE

[75] Inventor: Julius Miller, Melbourne, Fla.

[73] Assignee: Electronic Sheetmetal Craftsmen of Florida, Inc., Melbourne, Fla.

[22] Filed: Oct. 14, 1975

[21] Appl. No.: 621,778

[52] U.S. Cl. ..... 248/297; 248/123

[51] Int. Cl.[2] ..... G12B 3/00; A47G 29/00

[58] Field of Search ..... 248/297, 123, 330, 17; 254/112, 178

[56] References Cited

UNITED STATES PATENTS

| | | | |
|---|---|---|---|
| 906,583 | 12/1908 | Harvison et al. | 254/112 |
| 1,239,666 | 9/1917 | Bladholm | 248/297 |
| 2,975,573 | 3/1961 | Boal | 248/330 X |
| 3,780,386 | 12/1973 | Fouks | 211/148 X |

*Primary Examiner*—J. Franklin Foss

*Attorney, Agent, or Firm*—Morse, Altman, Oates & Bello

[57] ABSTRACT

A spring-loaded hoist mountable vertically on a wall is provided for use particularly in mounting a heavy television receiver to a wall and raising it to an elevated position. The hoist includes a fixed housing which is attached permanently to the vertical wall of a room and is formed with a vertical guide channel. A movable carriage is mounted within the housing for vertical reciprocation along the guide channel and is urged upwardly by means of a constant force spring reel assembly mounted in the top of the housing and connected to the carriage. The carriage includes a locking mechanism adapted to engage the housing for locking the carriage in a lowered position and also includes a connecting member adapted to engage a cooperating connecting member of a television by means of which the carriage, when unlocked and supporting a television, may be raised or lowered with little physical effort.

6 Claims, 4 Drawing Figures

WALL MOUNTED LIFT FOR A TELEVISION RECEIVER OR THE LIKE

BACKGROUND OF THE INVENTION

1. Field of the Invention

This invention relates generally to hoisting devices and more particularly is directed towards a new and improved spring-compensated lift for use in raising and lowering heavy appliances such as television receivers and the like with very little effort.

2. Description of The Prior Art

In certain instances it is the practice to temporarily mount relatively heavy objects in an elevated position. For example, in the rental of television sets in hospitals, the practice has been to install a television on a wall-mounted bracket on the order of 6 to 8 ft. high to permit the patient to view the set comfortably from his bed. The set is removed at the end of the rental term and replaced whenever a patient desires a receiver. Heretofore, the wall brackets for the television sets have been simple rigid devices which required the services of two men and a step ladder to raise and lower the set to and from the bracket. The television receivers are relatively heavy and color sets commonly weigh on the order of 65 to 70 pounds. The weight is such, therefore, that it is impractical for an individual conveniently to mount the receiver without assistance. The additional help required for services of this nature, therefore, adds to overhead which, in turn, is reflected in hospital rates charged to patients.

Accordingly, it is an object of the present invention to provide a compact wall-hoist for television receivers and the like which is capable of supporting the receiver for vertical reciprocation with little physical effort.

SUMMARY OF THE INVENTION

This invention features a wall-hoist for televisions and the like, comprising a housing mountable in a vertical position on a wall and formed with a vertical guide channel therein. A carriage is mounted within the housing for movement along the guide channel and is adapted to engage and support a television or other appliance detachably coupled thereto. The carriage is operatively connected to a constant force spring which provides sufficient force on the carriage to allow the carriage to be moved easily up or down with the receiver in place with very little effort. The carriage is provided with a lock mechanism for restraining the spring-loaded carriage in a lowered position to permit loading and unloading. When loaded the weight of the receiver counter-balances the force of the spring and the carriage may be unlocked.

DETAILED DESCRIPTION OF THE PREFERRED EMBODIMENT

Figure 2:
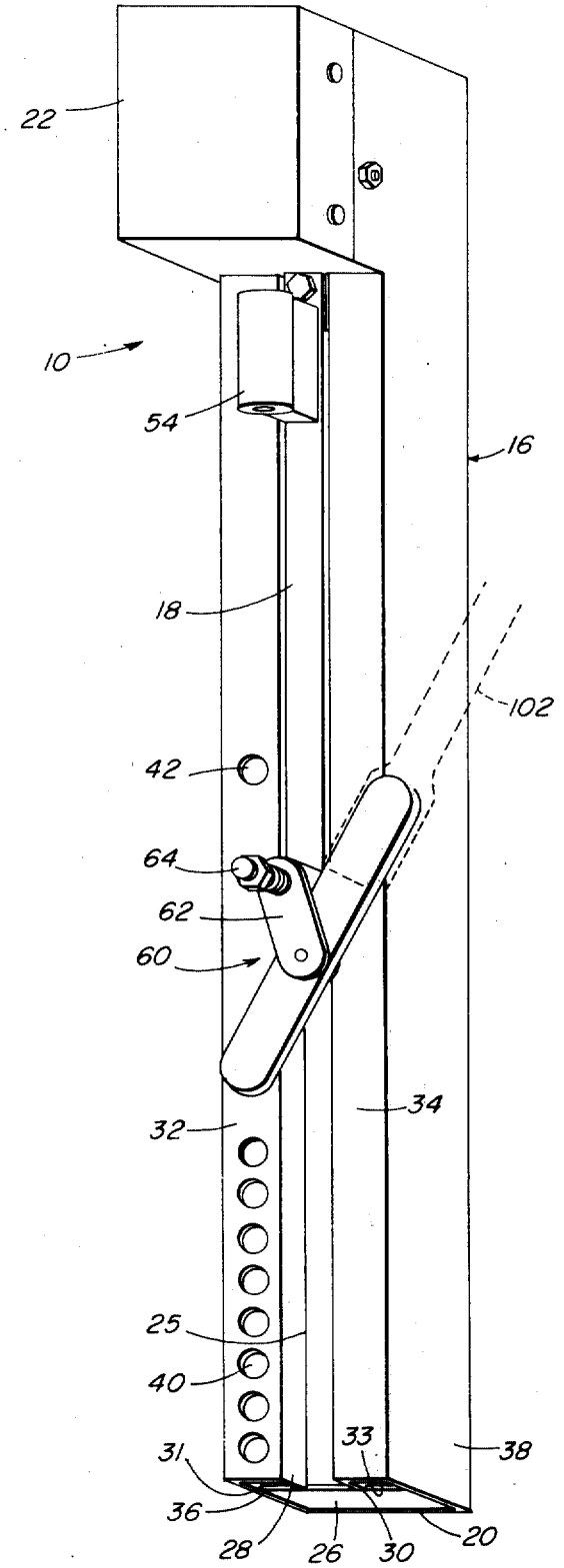
FIG. 2 is a view in prespective of the wall-hoist of FIG. 1.

Referring now to the drawings, the reference character 10 generally indicates a hoist mountable to a vertical support such as a wall 12 and adapted to support an appliance 14 such as a television receiver or the like. The hoist 10 is comprised of a housing 16 of elongated, narrow construction, fabricated typically from a sheet metal and a carriage 18 movably mounted within the housing and adapted to connect with the television receiver 14 for raising and lowering the receiver to and from an elevated position on the wall. The housing 16 is of a boxed, rigid construction and is permanently installed on the wall 12 by means of screws, bolts or the like driven through holes formed in a back wall 20 of the housing. Access to screw holes at the top of the housing is obtained by removing a cover plate 22 enclosing a constant rate spring mechanism 24 mounted in the enlarged top of the housing. Access to screw holes in the center and bottom of the housing is through a guide slot 25 extending lengthwise in the front of the housing. The slot 25 terminates at its lower end by means of a bottom plate 26 and at the upper end by means of the front overhang of the spring enclosure. As best shown in FIG. 2, the slot 25 extends between spaced apart opposing walls 28 and 30 formed by U-shaped bends defining parallel channels 31 and 33 within the housing. The channels include coplanar front wall sections 32 and 34 and side walls 36 and 38 extending forwardly from the rear wall 20. The front wall section 32 is formed with a plurality of spaced lower locking holes 40, typically eight in number, and a single medial locking hole 42. The housing may be made up in various sizes although an overall length of about five and one-half feet with a carriage travel of four feet is sufficient for most typical installations. In practice, the housing is mounted to the wall with the top of the housing eight feet from the floor. The housing may be mounted on the surface of the wall or may be recessed in the wall with only the front of the housing exposed and flush with the wall.

The carriage 18 is mounted for vertical movement within the housing and includes an elongated carriage frame 44 preferably of rigid steel construction.

The carriage frame 44 typically may be on the order of perhaps a foot or so in length and perhaps one inch in width and includes two pairs of ball-bearing assemblies 46(*a*), (*b*), (*c*) and (*d*) serving as the rollers with one pair of rollers at each end of the frame 44. The rollers are dimensioned to engage and ride in the U-shaped channels 31 and 33 formed within the housing on either side of the slot 25 to provide a low friction movement of the carriage assembly during reciprocation thereof. Each pair of rollers 46 is mounted on a shaft 48 in the form of a threaded bolt secured at one end by a nut 50 and carrying washers 52 on either side of the main frame in sufficient number and thickness to space the rollers along the shaft for proper positioning within the channels.

Mounted to the upper end of the main frame 44 is a connector 54 which extends through the slot 25 and is adapted to engage with a cooperating connector 56 mounted to the rear of the telivision receiver 14. While various connectors may be employed to provide a detachable coupling between the carriage and the television receiver, a preferred connecting arrangement is as illustrated. This is comprised of a tubular socket in the connector 54 which is mounted vertically to the main frame of the carriage, as shown, and adapted to engage a mating, downwardly extending pin 58 forming part of the television connector 56. The pin 58 is located near the top rear wall of the telivision and is adapted to drop down into the socket connector 54 on the carriage in a simple, effective locking engagement.

The carriage assembly also includes at its lower end a locking assembly 60 adapted to lock the spring-loaded carriage in a lowered position for loading and unloading a television set to the carriage and for locking the carriage in a lowered position when the unit is not in use. The locking assembly includes a relatively short bifurcated link 62 pivotally connected at its upper end to a bolt 64 extending perpendicularly from the front lower end of the carriage and held in position by means of a helical spring 66 and a nut 68. Washers 70 are also provided to space the link at the proper position with respect to the front wall of the housing. The controlled pressure from the spring 66 allows the link 62 to pivot easily on the shaft 64. Bearings 72 are provided at the top and bottom of the carriage frame 44 to reduce and minimize side friction. These rollers 72 are mounted to ride against the housing sides 28 and 30.

Figure 3:
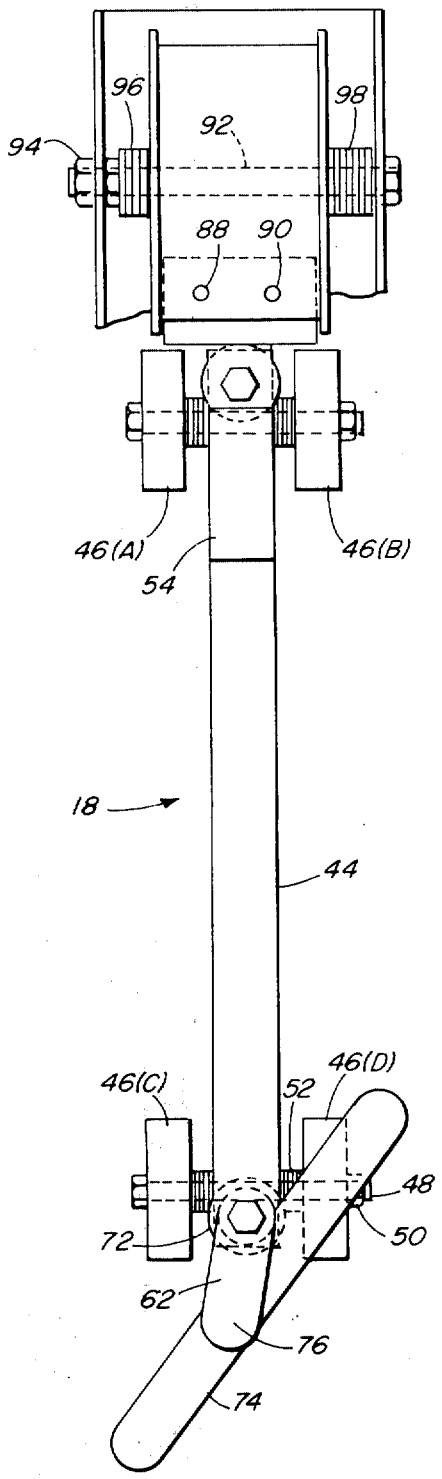
FIG. 3 is a view in side elevation of the carriage and spool mechanism, and, FIG. 4 is a view in side elevation of the carriage and spool assembly.
Figure 4:
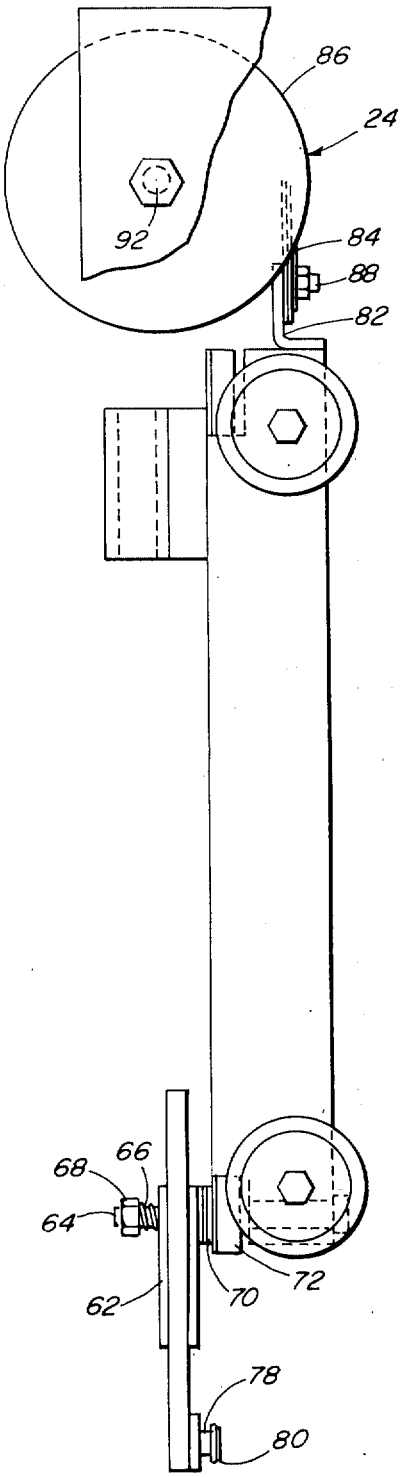

The lower end of the link carries a lever arm 74 pivotally connected by means of a pin 76 passing through the link and a medial portion of the lever arm 74, as best shown in FIG. 3. Mounted on the lower free end of the lever arm 74 and on the inner face thereof is a lock pin 78 having an enlarged head 80 at the outer end thereof. The lock pin 78 is adapted to engage any one of the cooperating locking holes 40 and 42 formed in the front wall of the housing in order to lock the carriage in any selected position, as required. The enlarged head 80 serves to prevent the pin 78 from becoming accidently dislodged from any locking holes. It will be understood that the carriage when not restrained by the weight of a television receiver 14, will have a normal upward force on the order of 65 to 70 lbs. by virtue of the spring reel assembly 24 and thus the carriage must be locked in a lowered position for normal operation as will be described more fully below.

The upper end of the carriage frame 44 is connected by means of an angle piece 82 to the outer end of a flat spring 84 wound about a spool 86. One leg of the angle piece is welded or otherwise fixed to the carriage frame 44 while the other leg is connected to the flat spring 84 as by fasteners 88 and 90 such as bolts, rivets or the like.

The spool 86 is carried for free rotation by a bolt axle 92 extending through the side walls of the housing and secured by nuts 94 on one end and by the head of the bolt on the other end. Spacing washers 96 and 98 are provided on either side of the spool for proper positioning of the spool along the axle to insure that the carriage moves smoothly in its channels and centered with respect to the slot 24.

The spring assembly 24 preferably is a constant force spring such as the type sold under the trademark NEGATOR by Ametek Hunter Spring Division of Hatfield, Pennsylvania. The spring assembly involves a prestressed strip of flat spring stock which coils tightly around a bushing or, as in the preferred embodiment, around successive layers of itself. When the spring is deflected by pulling out the outer or free end of the coil, a resisting force results which does not increase with increasing deflection or extension of the spring as would occur with a conventional extension spring. The change from original curvature of the material to a straightened condition occurs within a short zone where the straightened section merges into the curved section and, after passing through the zone, the material flattens although not completely, in the directional of pull. The straightened section of the spring stores the energy converted but adds nothing further to the force. The force results from the tendency of the material to recoil around the bushing with this high recoiling force being related to the configuration in the zone where the first flat section bends onto the spool. There is no friction inherent in the spring and the only friction involved is in the bearing of the bushing. The result is that a constant force spring develops in which resisting forces are incremental rather than cumulative.

Figure 1:
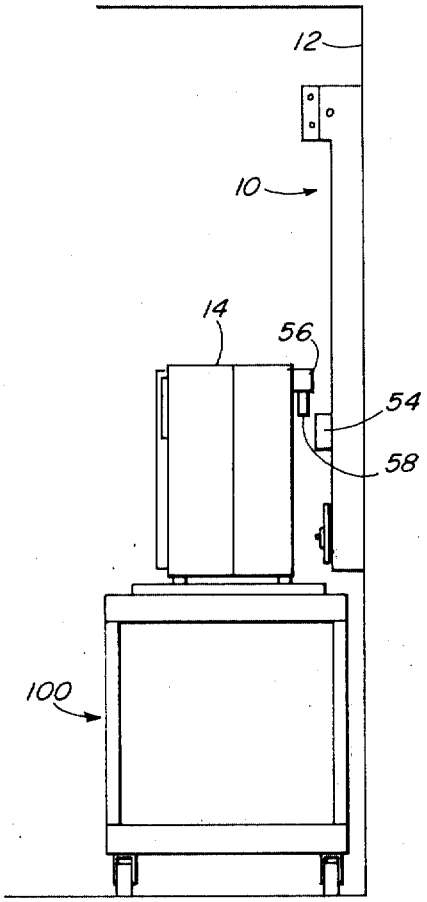
FIG. 1 is a view in side elevation of a wall-hoist made according to the invention together with a television receiver in position for loading.

The lift mechanism is operated in the following manner. Once the unit has been mounted to the wall, the carriage is pulled down by grasping the lever handle 74, pulling the carriage down until the lock pin 78 engages one of the locking holes 40. The particular hole selected depends on the height of a wheeled cart 100 or the like which may be used to transport the television set 14 from a storage room or other area to the unit 10 to which the receiver is to be mounted. The carriage should be lowered to a position where the television connector pin 58 can be mounted easily into the carriage connector socket 54 as suggested in FIG. 1. In order to hold the carriage down against the force of the spring while the lock pin 78 is being engaged, it may be necessary to use a separate bar or rod temporarily inserted between the top of the carriage and the overhang of the housing. In any event the lock is engaged by pressing in the lower end of the lever arm so that the pin engages the selected locking hole 40.

For normal operation a detachable extension handle 102 may be added to the lever arm 74. In order to install a television receiver, the cart is rolled adjacent to the lift 10 with the pin 58 next to the socket 54. The handle 102 is pulled down until the socket is below the pin 58, and the cart is then pushed in sufficiently so that the pin 58 aligns above the socket at which point the lever handle is fully released so that the carriage moves up sufficiently for the socket 54 to engage the pin. The television receiver is now connected to the hoist and the television receiver is raised slightly above the top of the cart. The cart is then removed and the lever handle 102 may also be removed. In order to relieve pressure on the lock pin 78 a slight pressure is applied to the top of the television by merely pushing down on the receiver. The lock is then released by pushing in the upper end of the lever 74 or pulling out the lower end in order to disengage the lock pin from the hole. The set may then be raised by a gentle upward hand pressure until it is raised to within one inch of the upper limit of the carriage movement. With a slight additional upward pressure with one hand, the set will touch the top and with the other hand the lock pin 78 is pressed into the upper locking hole 42. Upon releasing the pressure on the set, the TV will drop slightly down to rest on the pin lock. The receiver is then in its regular viewing position.

The set may be removed from the unit by merely disengaging the lock pin from the locking hole 42 and pulling the receiver down to the original lower position and reversing the installation procedure.

Having thus described the invention what I claim and desire to obtain by Letters Patent of the U.S. is:

1. An appliance hoist, comprising a. an elongated frame mountable to a vertical support, b. said frame being formed with a vertical guideway, c. a carriage mounted to said frame for movement along said guideway, d. constant force spring means connected to said frame and to said carriage and urging said carriage normally upwards, e. lock means operatively associated with said carriage and said frame for locking said carriage in a selected position along said guideway, and, f. connector means mounted to said carriage for detachably engaging said appliance whereby said appliance may be reciprocated along said guideway upon disengagement of said lock means, g. said spring means including a spool rotatably mounted to said frame and a prestressed normally coiled spring strip connected at one end to said spool and at the other end to said carriage, said strip being tightly wound in face-to-face convolutions when in a relaxed condition and being characterized by a natural tendency to recoil about said spool at a constant force when the other end is pulled straight from said spool, the straightened portion of said strip storing the recoiling force of said strip, the recoiling force of said spring being a function of the configuration of the strip between the coiled portion thereof and the straight portion thereof.

2. An appliance hoist according to claim 1 wherein said lock means includes a movable lever handle mounted to said carriage and formed with a pin at one end thereof, said frame being formed with at least one hole adjacent said pin when said carriage is in a lowered position and adapted to receive said pin in locking engagement.

3. An appliance hoist according to claim 1 wherein said frame includes a track along said guideway and said carriage includes at least one roller mounted for movement along said track.

4. An appliance hoist according to claim 1 wherein said frame is in the form of a hollow housing including a pair of spaced parallel channels extending vertically with respect to said frame, said housing being formed with a vertical slot between said channels to define said guideway, said carriage including rollers movable along said channels and said connector means being mounted to said carriage for movement along said slot.

5. An appliance hoist according to claim 4 wherein said housing is formed with a plurality of vertically spaced holes in the front thereof adjacent said slot to form one part of said lock means and a movable lever mechanism mounted to said carriage and extending through said slot, a pin mounted to one end of said lever mechanism in position to engage one of said holes according to the position of said carriage and forming another part of said lock means, said lever mechanism including a link pivotally mounted at one end to the lower portion of said carriage about a first horizontal axis extended to the front of said hoist and a lever handle pivotally connected about a second axis parallel to said first axis at a medial point to the other end of said link, said pin being mounted to one end of said lever handle.

6. An appliance hoist according to claim 5 wherein said pin is formed with an enlarged head portion.

* * * * *